United States Patent [19]

Ennis, Jr. et al.

[11] 4,107,226

[45] Aug. 15, 1978

[54] METHOD FOR QUENCHING CRACKED GASES

[75] Inventors: Bernard P. Ennis, Jr.; James R. Styslinger, both of Houston, Tex.

[73] Assignee: Pullman Incorporated, Chicago, Ill.

[21] Appl. No.: 843,462

[22] Filed: Oct. 19, 1977

[51] Int. Cl.[2] ..... C07C 3/08

[52] U.S. Cl. ..... 260/683 R; 208/48 Q; 208/130

[58] Field of Search ..... 260/683 R; 208/48 Q, 208/130

[56] References Cited

U.S. PATENT DOCUMENTS

| | | | |
|---|---|---|---|
| 3,180,904 | 4/1965 | Fischer et al. | 260/683 R |
| 3,487,121 | 12/1969 | Hallee | 260/683 R |

FOREIGN PATENT DOCUMENTS

| | | | |
|---|---|---|---|
| 1,469,918 | 2/1967 | France | 260/683 R |
| 1,149,360 | 4/1969 | United Kingdom | 260/683 R |

*Primary Examiner*—Delbert E. Gantz
*Assistant Examiner*—C. E. Spresser

[57] ABSTRACT

A method for quenching cracked gases and recovery of heat therefrom by cooling the gases in heat exchange with steam to increase superheat level of the steam and subsequently recovering heat from the superheated steam.

12 Claims, 3 Drawing Figures

Figure 1:
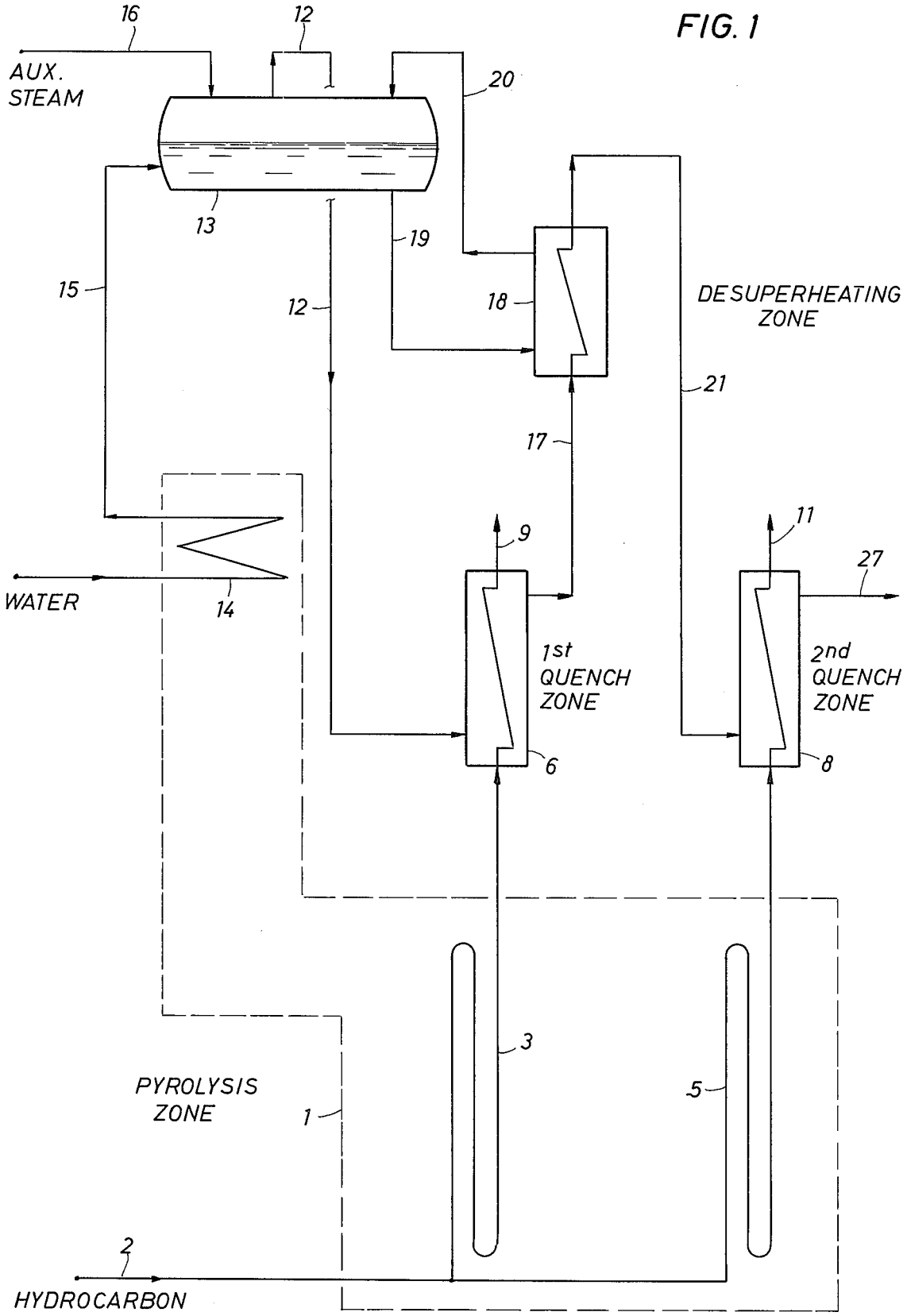

16
12
AUX.
STEAM
20
13
19
15
12
18
DESUPERHEATING
ZONE
21
17
9
11
27
WATER
14
1st
QUENCH
ZONE
2nd
QUENCH
ZONE
6
8
3
5
PYROLYSIS
ZONE
1
2
HYDROCARBON

METHOD FOR QUENCHING CRACKED GASES

This invention relates to the quenching of cracked gases obtained by steam cracking hydrocarbons to produce olefins and the recovery of heat therefrom.

In the steam cracking of hydrocarbons by pyrolysis in a direct-fired tubular furnace, it is generally accepted that, regardless of the feedstock utilized or the depth of cracking (severity) that occurs, rapid quenching of cracked gases is necessary to arrest pyrolysis reactions in order to maintain high yield of olefins with minimum production of methane tail gas. It has also been recognized that heat must be recovered from the cracked gases, customarily as steam, at the highest pressure and greatest quantity economically feasible to satisfy the compression energy requirements of downstream equipment for the separation of cracked gases and recovery of olefins. Product gas and refrigeration compressors used in this service may be electrically driven with electrical power derived from an integrated high pressure steam system wherein part or all of the steam is generated by indirect quench of cracked gases. More commonly, steam generated by quenching cracked gases is utilized directly, or via an integrated steam system, in steam turbines which drive the compression equipment.

In many parts of the world, particularly in the United States, ethane, propane, and to lesser extent, naphtha, have been commonly used steam cracking feedstocks. Cracked gases from these feed materials are typically heat exchanged with water in one or more shell and tube type heat exchangers which quench and cool the cracked gases and recover heat in the form of high pressure steam. This high pressure steam is superheated in, for example, the convection section of the cracking furnace or a separate superheater and thus rendered suitable for use in high pressure steam turbines which drive compression equipment, pumps, and blowers.

As the preferred gaseous feedstocks have become increasingly scarce, olefin producers have turned to heavier starting materials such as full range naphthas, light, medium, and heavy gas oils, and, in some instances, whole crude oil. While these feedstocks crack more easily, i.e. — at lower temperature, their tendency to form tars and carbon during and subsequent to pyrolysis regrettably increases with increasing molecular weight of the feed. When cracking heavy feeds, the tars and carbon rapidly deposit on the relatively cool heat exchange surfaces of quenching and cooling equipment and render the equipment ineffective. It is therefore generally understood that the wall temperature of quench and cooling devices should not be lower than the dewpoint of the cracked gas component having the highest boiling point. Since the use of water as coolant results in relatively low tube wall temperatures, water heat exchangers typically used to quench cracked gases in gas feed pyrolysis are not generally suitable for use in heavy liquid feed pyrolysis. This is particularly true when medium or heavy gas oils are the starting material.

To overcome this problem, producers utilizing heavy feed material have turned to various oil quenching schemes which typically involve direct contact quenching of cracked gases with a cooled oil stream removed from the downstream effluent fractionator which separates normally gaseous from normally liquid pyrolysis products. This technique sidesteps the coke deposition problem completely since no heat transfer surfaces are utilized and the coke passes to the fractionator where it is removed with the bottom cut. Regrettably, the technique also precludes generation of high pressure steam since heat must now be recovered at significantly lower temperatures in the fractionation system. Despite this serious limitation, oil quench systems are well established and are regarded by some practitioners as the only feasible means of quenching cracked gases in gas oil feed pyrolysis units.

To compound the problem, many olefins producers now find that they cannot rely on continued availability of a single type of feedstock. Since quench techniques suitable for gas feed pyrolysis are not suitable for gas oil feed pyrolysis and vice versa, the olefins producer is obliged to install different types of pyrolysis and quench facilities that can be utilized according to the currently available feedstock. A significant portion of these facilities will, therefore, either be operating inefficiently, or will be idle much of the time.

An object of this invention is to provide a method for quenching cracked gases obtained by steam cracking hydrocarbons and the recovery of heat therefrom.

A further object of this invention is to provide a method for quenching cracked gases obtained by steam cracking gas oils and the recovery of high level heat therefrom in the form of high pressure steam.

According to the invention, a process is provided for quenching cracked gases containing olefins produced by the steam pyrolysis of a hydrocarbon and recovering heat from the cracked gases by passing them in indirect heat exchange with steam to superheat the steam and subsequently desuperheating the steam by indirect heat exchange with water to produce steam at an elevated pressure and thereby recover heat. By practice of the process, a quench system suitable for a broad range of pyrolysis feedstocks is provided which makes possible the generation of high pressure steam from heat contained in the cracked gases.

Steam pyrolysis equipment suitable for practice of the process of the invention is any tubular furnace capable or cracking one or more hydrocarbon fractions such as ethane, propane, butane, light naphtha boiling between about 90° F and 250° F, full range naphtha boiling between about 100 ° F and 375° F, light gas oil boiling between about 350° F and 700° F, medium gas oil boiling between 450° F and 850° F, heavy gas oil boiling between 600° F and 1000° F or mixtures thereof. With specialized furnace design, whole petroleum crude oil may be utilized as cracking feedstock.

Typically, the tubular furnace will have one or more radiant sections containing high temperature cracking tubes fired by a plurality of gas or oil burners located in the walls, arch, or floor of the furnace enclosure. Quite commonly two or three cracking tubes of 4 to 6 inches diameter are employed, however, tube arrays may vary from a single, large diameter tube to those utilizing a multiplicity of small diameter tubes. These tubes may be manifolded together at the outlets to collect gases into one or more headers for subsequent quenching or the cracking tubes may be connected to individual, single tube quench devices of the shell and tube type. Cracking tube outlet temperatures vary from about 1300° F to about 1900° F depending upon the choice of starting material, desired yields, and desired product mix. Typical radiant tube outlet temperatures utilized in the cracking of light to heavy gas oils range from about 1300° F to about 1700° F.

Additionally, the tubular furnace will have one or more convection sections where heat is recovered from radiant burner combustion gases and utilized to preheat feedstock and to generate or superheat steam which is utilized in turbine drives, process heating, and as diluent steam in pyrolysis.

Satisfactory apparatus for use in the quench zone are conventional shell and tube heat exchangers having single or multiple tubes preferably arranged in a single pass which have been designed to accommodate thermal gradients resulting from the high temperature of the cracked gases.

In one embodiment of the invention, saturated steam at a pressure of from about 50 psia. to about 3100 psia. is passed to the quench zone to receive heat by indirect heat exchange with cracked gases at a temperature of from about 1300° F to about 1900° F and thereby quenching these gases to a temperature of from about 500° F to about 1200° F to arrest the pyrolysis reactions. The cracked gases are then passed to subsequent cooling stages in order to lower the cracked gas temperature to a level at which normally gaseous products such as olefins, hydrogen, and $C_1$ to $C_4$ paraffins may be separated from normally liquid products such as pyrolysis gasoline and oil and cracking residues in a pyrolysis effluent fractionator. These subsequent cooling stages may be shell and tube type heat exchangers for the further recovery of low level heat or direct oil quench stages which rely on low level heat recovery in the efluent fractionation system.

Flow of saturated steam in the quench zone is preferably cocurrent with the flow of cracked gases in order to maintain a relatively constant tube wall temperature throughout the length of the quench zone. Tube wall temperature is most preferably maintained above the dew point of cracked gases. The preferred use of heat recovered from the quench zone in the form of high pressure steam is motive power for the product gas and refrigerant compression services previously mentioned. With this use as an example, the preferred pressure range of saturated steam coolant to the quench zone is from about 500 psia. to about 3100 psia. with corresponding saturation temperatures of from about 465° F to about 700° F.

In the quench zone, superheat of the steam is increased from essentially zero to about 300 ° F by heat exchange with the hot cracked gases. Superheat may be increased by as much as 700° F. This steam, having increased superheat, is then passed to a desuperheating zone and indirectly heat exchanged with water at a slightly higher pressure which has preferably been preheated to the saturation temperature. Accordingly, superheat is removed from the quenching steam and heat is recovered from the desuperheating zone in the form of saturated steam at an elevated pressure which may then be utilized as supply coolant to the quench zone.

Desuperheated steam leaving the desuperheating zone may be at the saturation temperature for the pressure utilized or may retain some superheat in the order of about 50° F above the saturation temperature. This steam may be resuperheated in a convection coil of the pyrolysis section or a separate steam superheater for subsequent use as turbine drive steam for the previously mentioned compression equipment. Preferably the temperature of steam leaving the desuperheating zone will be controlled to within about 25° F of the temperature at which it entered the first quench zone and then passed to a second quench zone for quenching cracked gases from another radiant coil or tube bank in the same or other pyrolysis zone. This desuperheated steam is again superheated by indirect heat exchange with cracked gases in the second quench zone which is operated in a manner similar to that of the first quench zone and superheated steam at a pressure of from about 50 psia. to 3100 psia. is recovered from the second quench zone for use in steam turbine drives. Preferably, steam recovered from the second quench zone for use in steam turbines driving gas and refrigerant compression equipment will be at a pressure of from about 500 psia. to about 3100 psia. and will have from about 200° to about 500° F of superheat. When superheated steam is recovered within the above-mentioned pressure range of this embodiment of the invention, the pressure of steam in the first quench zone and the desuperheating zone will be within the same range.

In instances where multiple-quench zones are utilized, such as where steam availability is limited, one or more intermediate quench zones and desuperheating zones may be utilized. In an embodiment utilizing for example one intermediate step, desuperheated steam leaving the desuperheating zone is passed successively through an intermediate quench zone, intermediate desuperheating zone, and then to the second quench zone. Saturated steam generated from water introduced to the desuperheating zones is preferably comingled in a steam drum prior to its introduction to the first quench zone as coolant. A conventional thermosyphon is the preferred means of introducing water from a steam drum to the desuperheating zones and recovering saturated steam in the drum from the desuperheating zones.

In another embodiment of the invention, superheated steam at relatively low pressure is utilized as coolant in the quench zone. This embodiment permits a less rigorous mechanical design of quench apparatus owing to utilization of lower steam pressures in instances where lower tube wall temperatures are utilized, i.e. — with light feedstocks. In this embodiment, steam at a pressure of from about 50 psia. to about 1000 psia., superheated to about 300° F to about 800° F, is introduced to a quench zone wherein its superheat is increased by indirect heat exchange with cracked gases. This steam is then passed to a desuperheating zone for recovery of the increased superheat by indirect heat exchange with water at high pressure to generate steam at an elevated pressure of from about 500 psia. to 3100 psia. The elevated pressure steam may be superheated in convection coils of the pyrolysis section or a separate superheater and utilized as turbine drive steam.

Desuperheated steam leaving the desuperheating zone at relatively low pressure may be utilized for process heating, or may be resuperheated in convection coils of the pyrolysis section or by heat exchange with hot, high pressure turbine exhaust steam for subsequent use in low pressure turbines. Preferably, desuperheated low pressure steam will flow from a first desuperheating zone at substantially the same temperature it entered the first quench zone to a second quench zone where it is resuperheated by indirect heat exchange with cracked gases. The resuperheated low pressure steam leaving the second quench zone is again desuperheated in a second desuperheating zone where additional high pressure steam is raised by indirect heat exchange with water. As in a previously described embodiment, water used for generation of high pressure steam is preferably preheated to the saturation temperature corresponding to the specific pressure selected for operation of the high pressure steam system. Preheated water may flow through a steam drum and is then passed to the desuperheating zone via the downcomers of thermosyphons where steam is raised and subsequently passed to the steam drum. As previously described, saturated high pressure steam from the steam drum is then superheated, preferably in the convection section of the pyrolysis zone and then utilized as motive power for high pressure steam turbines.

Illustrative examples of the process of the invention are described in the drawings and following description.

FIG. 1 describes a high pressure, saturated steam quench system which recovers heat in the form of high pressure steam.

Figure 2:
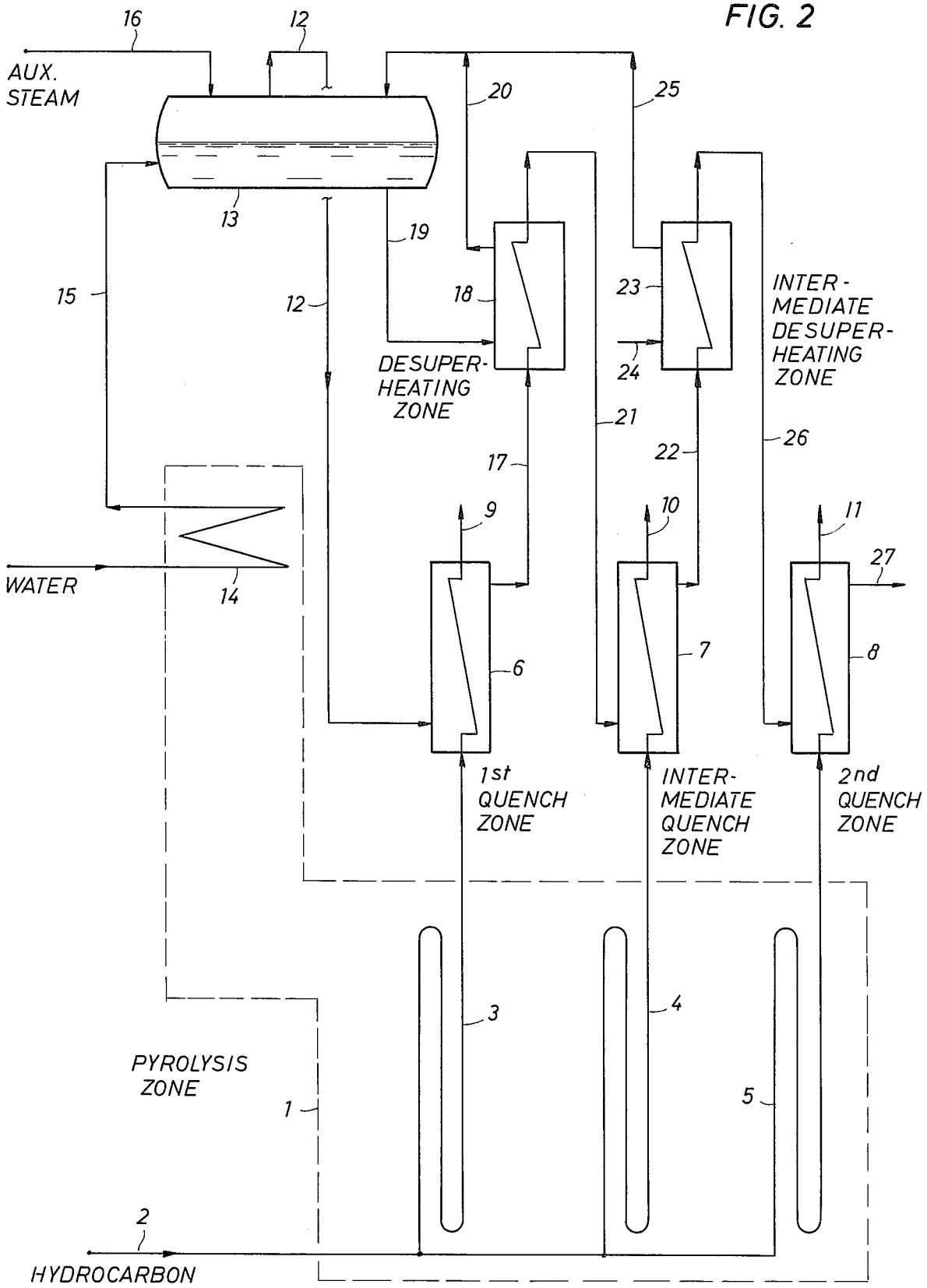

FIG. 2 describes a multiple pass, high pressure steam quench system which recovers heat in the form of high pressure steam and utilizes saturated steam as coolant in a first quench zone.

Figure 3:
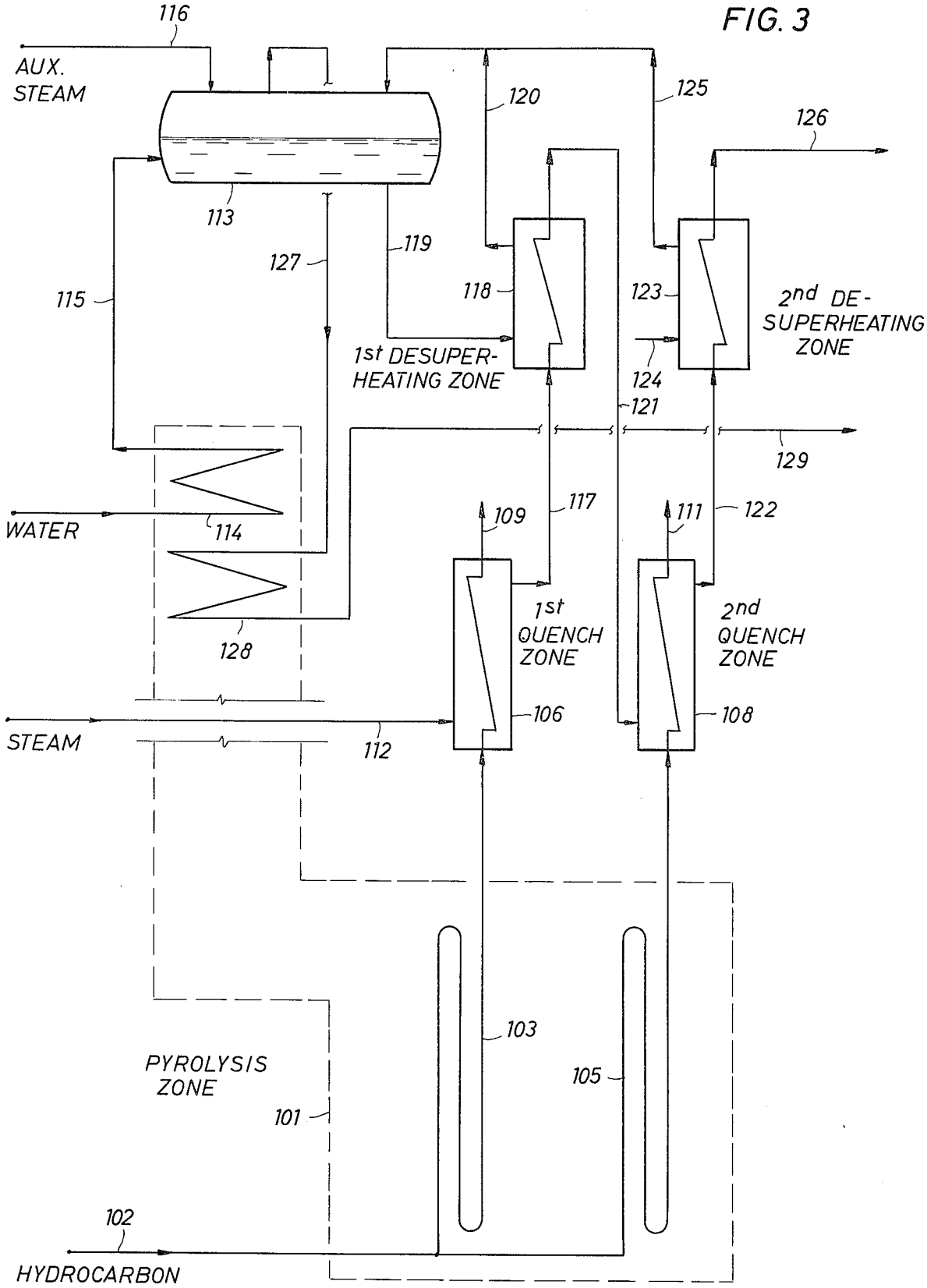

FIG. 3 describes a relatively low pressure steam quench system which recovers heat in the form of high pressure steam and utilizes superheated steam as coolant in a first quench zone.

Referring now to FIG. 1, a preheated gas oil feedstock diluted with steam enters pyrolysis zone 1 via line 2 at a temperature of 1000° F and is distributed to radiant coils 3 and 5 which are conventionally fired by oil burners located in the radiant section of the pyrolysis zone.

Feedstock is heated to a cracking temperature of 1600° F to produce olefins, normally liquid hydrocarbons, hydrogen, and methane. The cracked gases are passed to quench zones 6 and 8 where the cracking reactions are arrested by cooling the gases to a temperature of 1100° F in indirect heat exchange with steam. Quenched gases leave the respective quench zones via lines 9 and 11 and are collected in a common header for further cooling, compression, and separation of the cracked gases.

Steam coolant is supplied successively to the quench zones by line 12 which receives saturated steam at 1500 psia. from steam drum 13. Make-up water to the steam drum is heated by convection coil 14 located in the upper portion of the pyrolysis zone 1 and is passed via line 15 to the drum. Auxiliary steam is added to the drum through line 16.

Saturated steam coolant entering the first quench zone is superheated to a temperature of 900° F and passes via line 17 to desuperheating zone 18 where it is desuperheated to a temperature of 615° F by indirect heat exchange with water from thermosyphon 19, 20. Heat is recovered from desuperheating zone 18 as 1500 psia. steam in drum 13 and the resulting high pressure steam is passed to the first quench zone 6 as previously recited.

Desuperheated steam leaves desuperheating zone 18 at a temperature of 625° F and flows through line 21 to the second quench zone 8 where it is again superheated to a temperature of 900° F. Superheated steam at a pressure of 1500 psia. and temperature of 900° F leaving the second quench zone 8 is passed via line 27 to 1500 psia. high pressure turbines (not shown) which furnish motive power for the compression of cooled, cracked gases and refrigerant utilized in the separation and recovery of product olefins.

FIG. 2 illustrates a quench and heat recovery system quite similar to that described in FIG. 1. Descriptive numerals and operation are the same as in FIG. 1, however, an additional quench circuit is disposed intermediate the first and second quench zones resulting in a three pass quench system. Referring to FIG. 2, hot, cracked gases from additional radiant coil 4 located within pyrolysis zone 1 are passed to intermediate quench zone 7 and cooled to a temperature of 1100° F by indirect heat exchange with steam at a temperature of 625° F leaving desuperheating zone 18 via line 21. This steam is resuperheated in the intermediate quench zone and is passed to intermediate desuperheating zone 23 which operates in essentially the same manner as previously described desuperheating zone 18 through the functioning of thermosyphon 24, 25.

Desuperheated steam leaves the intermediate desuperheating zone 23 at a temperature of 625° F and flows through line 26 to the second quench zone 8 where it is again superheated to a temperature of 900° F. Subsequent operations are the same as those previously described in connection with FIG. 1.

FIG. 3 illustrates a quench and heat recovery system which also generates high pressure steam but utilizes medium pressure steam as coolant in the quench zones. Referring to FIG. 3, a preheated gas oil feedstock diluted with steam enters pyrolysis zone 101 via line 102 at a temperature of 1000° F and is distributed to radiant coils 103 and 105 which are conventionally fired by oil burners located in the radiant section of the pyrolysis zone.

Hot cracked gases from the radiant coils are passed to quench zones 106 and 108 where the cracking reactions are arrested by cooling the gases to a temperature of 1100° F in indirect heat exchange with steam. Quenched gases leave the respective quench zones via lines 109 and 111 and are collected in a common header for further cooling, compression, and separation of the cracked gases.

Steam coolant is supplied successively to the quench zones by line 112 which receives superheated steam at a pressure of 650 psia. and temperature of 625° . This steam is furnished from 1500 psia. high pressure steam turbines (not shown) exhausting at 650 psia. and 735° F. The exhaust steam is desuperheated to 625° F in a turbine steam desuperheater (not shown) prior to passage to the first quench zone 106.

Superheated steam coolant entering the first quench zone is further superheated to a temperature of 900° F and passes via line 117 to the first desuperheating zone where it is desuperheated to a temperature of 625° F by indirect heat exchange with water from thermosyphon 119, 120. Heat recovered from desuperheating zone 118 is recovered as 1500 psia. saturated steam in steam drum 113. Make-up water to the steam drum at a pressure of 1500 psia. is heated by convection coil 114 located in the upper portion of the pyrolysis zone 101 and is passed via line 115 to the drum. Auxiliary steam is added to the drum via line 116.

Desuperheated steam leaves the first desuperheating zone 118 and flows through line 121 to the second quench zone 108 where it is again superheated to a temperature of 900° F. This steam leaves the second quench zone via line 122 and is again desuperheated in the second desuperheating zone 123 to a temperature of 625° F by indirect heat exchange with water from thermosyphon 124, 125. Steam leaving the second desuperheating zone via line 126 is resuperheated in the previously mentioned turbine steam desuperheater (not shown) by exhaust from the high pressure turbines and is utilized as drive steam in 650 psia. medium pressure turbines.

As previously noted, 1500 psia. saturated steam is recovered in steam drum 113 by operation of thermosyphons 119, 120 and 124, 125. This saturated steam flows from the drum via line 127 to superheating coil 128 located in the convection section of the pyrolysis zone and is then passed through line 129 to 1500 psia. high pressure turbines (not shown) which furnish motive for the compression of cooled, cracked gases and refrigerant utilized in the separation and recovery of product olefins.

We claim:

1. A process for quenching cracked gases obtained by steam cracking a hydrocarbon fraction in a pyrolysis zone to produce olefins and the recovery of heat therefrom comprising:

quenching cracked gases in a quench zone by indirect heat exchange with steam to increase the superheat thereof and desuperheating steam having increased superheat in a desuperheating zone by indirect heat exchange with water to recover heat in the form of steam at an elevated pressure.

2. The process of claim 1 wherein steam entering the quench zone is saturated steam.

3. The process of claim 1 wherein steam entering the quench zone is superheated steam.

4. The process of claim 1 wherein the hydrocarbon fraction is predominantly a gas oil.

5. The process of claim 1 wherein the temperature of the cracked gases is from about 1300° F to about 1900° F and the temperature of steam entering the quench zone is from about 300° F to about 750° F.

6. The process of claim 2 wherein the pressure of steam entering the quench zone is from about 500 psia. to about 3100 psia. at a temperature of about from 465° F to about 700° F.

7. The process of claim 3 wherein the pressure of steam entering the quench zone is from about 50 psia. to about 1000 psia. at a temperature of about from 300° F. to about 800° F.

8. A process for quenching cracked gases obtained by steam cracking a hydrocarbon fraction in a pyrolysis zone to produce olefins and the recovery of heat therefrom comprising:

a. quenching cracking gases in at least two quench zones with steam to increase the superheat thereof wherein steam entering the first quench zone is saturated steam;

b. desuperheating steam having increased superheat in at least one desuperheating zone by indirect heat exchange with water to recover heat in the form of saturated steam at a pressure of from about 500 psia. to about 3100 psia.;

c. passing desuperheated steam to a second quench zone to quench cracked gases by indirect heat exchange thereby increasing the superheat of said desuperheated steam; and d. recovering the superheated steam from the second quench zone.

9. The process of claim 8 wherein the saturated steam recovered from the desuperheating zone is passed to the first quench zone.

10. The process of claim 8 which additionally comprises:

a. passing desuperheated steam from the desuperheating zone to a quench zone intermediate the first and second quench zones thereby increasing the superheat of said superheated steam;

b. passing the superheated steam from the intermediate quench zone to an intermediate desuperheating zone to desuperheat the steam; and c. passing the desuperheated steam from step (b) to the second quench zone.

11. A process for quenching cracked gases obtained by steam cracking a hydrocarbon fraction in a pyrolysis zone to produce olefins and recovery of heat therefrom comprising:

a. quenching cracked gases in at least two quench zones with steam to increase the superheat thereof wherein steam entering the first quench zone is superheated steam;

b. desuperheating steam having increased superheat in a first desuperheating zone by indirect heat exchange with water to recover heat in the form of saturated steam at a pressure of from about 500 psia. to about 3100 psia.;

c. passing desuperheating steam having increased superheat in a first desuperheating zone by indirect heat exchange thereby increasing the superheat of said desuperheated steam;

d. desuperheating steam from step (c) having increased superheat in a second desuperheating zone by indirect heat exchange with water to recover heat in the form of saturated steam at a pressure of from about 500 psia. to about 3100 psia.; and e. recovering the desuperheated steam from the second desuperheating zone.

12. The process of claim 11 wherein the pyrolysis zone includes a convection section for the discharge of hot combustion gases and the saturated steam recovered from a desuperheating zone at a pressure of from about 500 psia. to about 3100 psia. is resuperheated by indirect heat exchange with the hot combustion gases.

* * * * *

UNITED STATES PATENT OFFICE

CERTIFICATE OF CORRECTION

Patent No. 4,107,226 Dated August 15, 1978

Inventor(s) Bernard P. Ennis, Jr.; James R. Styslinger

It is certified that error appears in the above-identified patent and that said Letters Patent are hereby corrected as shown below:

In claim 11, at 13-16, delete paragraph C.

Insert new paragraph C as follows:

-- c) passing desuperheated steam from the first desuperheating zone to a second quench zone and therein increasing the superheat of the desuperheating steam by indirect heat exchange with cracked gases; --

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*